United States Patent [19]

Niedermaier et al.

[11] Patent Number: 4,919,049

[45] Date of Patent: Apr. 24, 1990

[54] WEB FEED PRINTING PRESS

[75] Inventors: Arnold Niedermaier, Beindersheim; Anton Weis, Lorsch, both of Fed. Rep. of Germany

[73] Assignee: Albert-Frankenthal AG, Frankenthal, Fed. Rep. of Germany

[21] Appl. No.: 325,566

[22] Filed: Mar. 20, 1989

[30] Foreign Application Priority Data

Apr. 13, 1988 [DE] Fed. Rep. of Germany ..... 3812295

[51] Int. Cl.[5] ..... B41F 13/54

[52] U.S. Cl. ..... 101/228; 226/31; 226/92; 318/7

[58] Field of Search ..... 101/232, 228, 226, 227, 101/219, 225; 226/4, 11, 24, 29, 30, 31, 42, 46, 92; 318/6, 7; 364/469, 471

[56] References Cited

U.S. PATENT DOCUMENTS

| | | | |
|---|---|---|---|
| 3,186,273 | 6/1965 | Tomberg | 226/31 |
| 3,276,647 | 10/1966 | Lewis, Jr. et al. | 226/31 |
| 3,539,085 | 11/1970 | Anderson | 226/31 |
| 4,004,570 | 1/1977 | Roch | 101/228 |
| 4,007,866 | 2/1977 | Traise | 226/31 |
| 4,078,487 | 3/1978 | McComb | 101/228 |
| 4,214,524 | 7/1980 | Corse | 101/228 |
| 4,658,723 | 4/1987 | Tokuno et al. | 101/228 |
| 4,719,855 | 1/1988 | Lannon et al. | 364/469 |
| 4,750,659 | 6/1988 | Maier et al. | 101/228 |
| 4,805,111 | 2/1989 | Steidel | 226/29 |

*Primary Examiner*—Eugene H. Eickholt
*Attorney, Agent, or Firm*—Edwin D. Schindler

[57] ABSTRACT

A web feed printing press, more especially a rotogravure press, has a longitudinal shaft for driving printing units and a device for driving the web draw rolls. In order to achieve a simpler design without any direct mechanical connected between the draw rolls and the longitudinal while still ensuring accurate drive operation the drive device for the pair of draw rolls comprises a main motor and an auxiliary motor each with an adjustable speed of rotation. A differential drive has two inputs and one output. The speed of rotation of the main motor is varied in a way dependent on the speed of rotation of the longitudinal shaft and the speed of rotation of the auxiliary motor is varied in accordance with the speed of rotation of the longitudinal shaft and of the tension of the web of paper to be printed. The auxiliary motor is coupled with a differential element of the differential drive, which is preferably in the form of a harmonic drive, so that a speed difference in the rotation between, on the one hand, the input of the differential drive connected with the main motor and, on the other hand, the output of the differential drive connected with the pair of draw rolls may be produced.

7 Claims, 1 Drawing Sheet

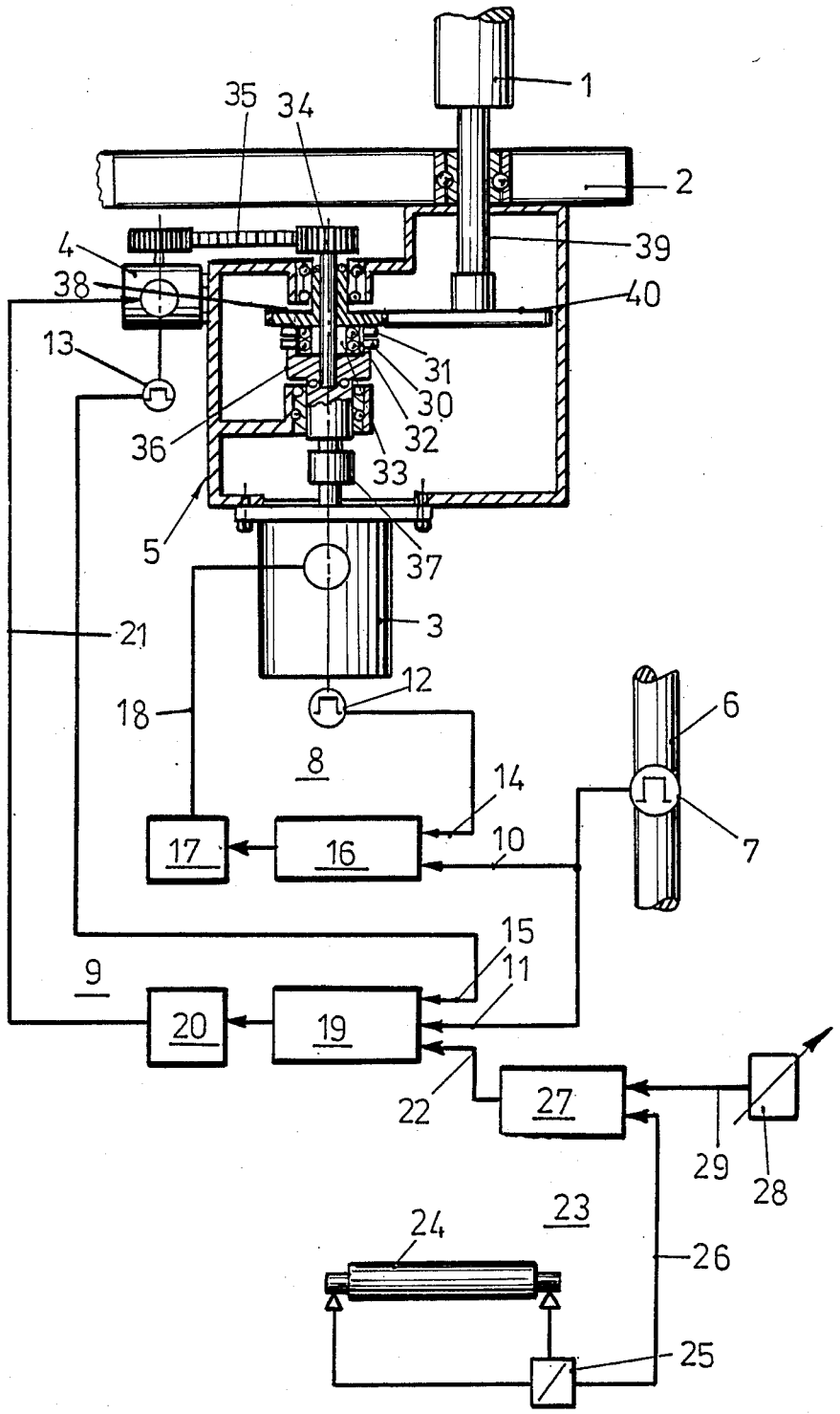
1
2
35
34
39
4
38
40
13
31
30
36
32
33
5
37
3
21
12
18
6
8
14
17
16
10
7
15
9
11
20
19
22
27
29
28
23
24
26
25

WEB FEED PRINTING PRESS

BACKGROUND OF THE INVENTION

The invention relates to a web feed printing press and more especially to a web feed gravure press compressing a longitudinal shaft for driving the printing units and with a device for driving at least one web draw roll.

In conventionally designed web feed gravure presses the draw rolls placed between the folder and the printing units are mechanically driven by the longitudinal shaft, the drive train including a transmission with a number of different speeds, which has to be reset for every change in the diameter of the cylinders of the printing unit. Arrangements of this type have become well accepted but they are complex in design. Furthermore, known systems with a mechanical drive for the draw rolls from the longitudinal shaft are noisy in operation. A further fact is that the mechanical drive train with the multispeed transmission makes a large amount of servicing necessary. A particularly serious disadvantage is that the drive train extending from the longitudinal shaft to the draw rolls requires a large amount of space and this impairs access to the printing press. A further point is that such a mechanical drive train only has limited possibilities of modification to suit different applications and, more specifically, it cannot be adapted to the geometry of the draw roll setup.

SHORT SUMMARY OF THE INVENTION

Taking these disadvantages of the prior art as a starting point, one object of the invention is to provide an arrangement of type specified which is so improved by the use of simple and inexpensive means that there is not only a simple construction which entails little servicing but also satisfactory accessibility to the printing press.

A further object of the invention is to allow the designer to freely select the spatial arrangement of the draw rolls while at the same time providing for high accuracy.

In order to achieve these or other objects appearing from the present specification, claims and drawings, the drive means associated with each draw roll comprises a main motor and an auxiliary motor with means for regulating the speed of the two motors and a differential drive with two inputs and one output, the speed of rotation of the main motor being able to be varied in accordance with the speed of rotation of the longitudinal shaft and the speed of rotation of the auxiliary motor being able to be varied in accordance with the speed of the longitudinal shaft and of the tension of the web to be printed and the auxiliary motor is connected with a differential element of the differential drive by means of which element a speed difference between, on the one hand, the speed of rotation of the input of the differential drive connected with the main motor and, on the other hand, the output, connected with the draw roll, of the differential may be produced.

These features provide a complete remedy for the initially mentioned disadvantages of the known arrangements. Since there is no longer any mechanical connection between the draw rolls and the longitudinal shaft, there is no need for the mechanical drive train so far required, so that, apart from the simplification of the construction generally, there is a general improvement in the accessibility to the printing press and as regards the position of the draw rolls there is a complete independence from mechanical features. At the same time the absence of a mechanical drive train makes servicing easier and reduces noise. Since there is a main motor cooperating with an auxiliary motor controlled in a way dependent on the web tension, there is a highly sensitive regulation of the web speed and thus a greatly reduced chance of tearing of the web. The remarks so far will make it clear that the invention achieves its objects with simple and economic means.

In accordance with an advantageous further feature of the invention the main and auxiliary motors may both be DC motors which are preferably digitally controlled. These features lead to a simple control system which is readily operated. The main torque is furnished by the main motor so that it is made with a suitably larger power rating.

In accordance with a further advantageous feature of the invention the differential drive is a harmonic drive whose wave generator is coupled with the auxiliary motor whose input circular spline is coupled with the main motor and whose output circular spline is connected with a draw roll to be driven. The harmonic drive involves the advantage of high a transmission ratio to convert the speed of rotation of the auxiliary motor. At the same time there is the useful feature of sufficient regulation lag and thus regulation without jerks.

In accordance with a further development of the invention the means for regulating the speed of rotation of the auxiliary motor may comprise a cascade with two regulating circuits, the circuit for regulation of the web tension being superimposed on the circuit for regulation of the speed of rotation. In this respect the circuit for regulation of the speed of rotation may then preferably constitute the lowermost or primary regulation means and thus the most rapid regulation circuit. A change in the web tension then advantageously leads to a change in the setting of the target value of the circuit for regulation of the speed of rotation. This leads to the useful effect that there is a practically complete avoidance of sudden changes.

In accordance with a further convenient feature of the invention the set point of the speed of rotation regulation circuit for the main motor and respectively the auxiliary motor may be established by the speed of rotation, as detected by a pulse generator, of the longitudinal shaft. This means that the desired dependence on the speed of rotation of the longitudinal shaft is achieved in a simple manner.

Further advantageous developments of the invention will be gathered from the ensuing account of one embodiment thereof as shown in the drawings and from the claims.

The single FIGURE of the drawing shows a block circuit diagram of a drive device in accordance with the invention as associated with one draw roll.

DETAILED DESCRIPTION OF EMBODIMENT OF THE INVENTION

The general structure and manner of operation of web feed rotary printing presses such as gravure presses are so well known that no detailed account thereof will be called for. Such arrangements as a rule comprise a series of tandem-arranged printing units placed between a web roll carrier and a folder at the delivery end. In the parts between the roll carrier and the first printing unit and between the last printing unit and the folder there are respective pairs of draw rolls, which draw the web to be printed from the roll support on the roll carrier and ensure web tension in the printing units. The pair of draw rolls coming after the printing units, at which the web speed has to be accurately controlled, is shown in the drawing.

In order to support this pair 1 of draw rolls there is a draw roll stand 2 formed by the oppositely placed side walls and which may be attached to the overhead folder structure in a manner which is here not shown in detail. The pair 1 of draw rolls comprises a drive roll and a non-driven or idler roll running on it.

For driving the driven roll of the pair 1 of draw rolls there is a main motor 3 and an auxiliary motor 4 which is smaller than it is. The main motor 3 has a power rating of around 25 kW. and the auxiliary motor a power of around 1 kW. The main motor 3 and the auxiliary motor 4 are connected with the driven roll of the pair 1 of draw rolls by a differential drive 5. The main motor 3 and the auxiliary motor 4 are DC motors and their speed of rotation is adapted to the longitudinal shaft 6, from which the drive of the printing units and of the folder is derived. The speed of rotation of the auxiliary motor 4 is furthermore dependent on the web tension, that is to say the tensile force in the paper web to be printed.

The speed of rotation of the longitudinal shaft 6 is sensed by a pulse generator 7 driven by the shaft. The pulse generator 7 supplies pulse signals and this facilitates a digital regulation of the motors 3 and 4, whose actual speed of rotation values may also be sensed by pulse generators. The output signal of the pulse generator 7 forms the target value of a speed of rotation regulating circuit 8 associated with the main motor 3 and a speed of rotation regulation circuit 9 for the auxiliary motor 4. The respective speed of rotation target value input of the regulating circuit 8 and, respectively, 9 is denoted 10 and, respectively, 11. The speeds of rotation of the main motor 3 and, respectively, of the auxiliary motor 4 are also sensed by a pulse generator 12 and, respectively, 13 associated therewith. The output signals of these generators 12 and 13 form the actual values of the speed of rotation for the regulating circuit 8 and, respectively, 9. The respective actual value inputs of the regulating circuits 8 and, respectively, 9 are denoted 14 and, respectively, 15. The regulating circuit 8 associated with the main motor 3 comprises a speed of rotation regulator 16, which is connected with the speed of rotation target value input 10 and the speed of rotation actual value input 14. The speed of rotation regulator 16 has its output terminal connected with a thyristor 17, which controls the supply of power to the main motor 3, as is indicated by a signal line 18. The thyristor 17 constitutes a digitally operated servo member. If there is a deviation of the actual value supplied via the input 14 to the regulator 16 from the set point value supplied via the input 10 to the regulator 16, the power supply to the main motor 3 is so altered that the deviation disappears and is corrected.

The speed of rotation regulator circuit 9 for the auxiliary motor 4 also comprises a speed of rotation regulator 19, whose output terminal is connected with a thyristor 20 controlling the supply of power to the auxiliary motor 4 via the signal line 21. The speed of rotation regulator 19 of the regulator circuit 9 has, in addition to the inputs 11 and 15, a third input 22, which varies the speed of rotation set point value, able to be supplied via the input 11, in a way dependent on the tension of the paper web that is to be printed. The input 22 of the regulator circuit 9 is accordingly the output of a web tension regulator circuit 23 on which the speed of rotation regulator circuit 9 is dependent. There is accordingly a cascade regulation system with an internal speed of rotation regulation circuit and an external web tension regulation circuit on which same is dependent.

The web tension is detected by means of a dandy roll 24 and a measuring member 25 associated therewith. The output of the member 25 is connected with the tension actual value input 26 of a tension regulator 27. The tension set point value is set by means of potentiometers 28, whose output is connected with the tension set point value input 29 of the tension regulator 27. The output of the tension regulator 27 is connected with the second set point value input 22 of the speed of rotation regulator 19 of the dependent speed of rotation regulator circuit 9. As a result, as described above, there is a tension-dependent alteration in the speed of rotation set point value of the dependent speed of rotation regulation circuit 9, this leading to high accuracy and less likelihood of tearing of the web or the like.

The differential drive 5 connecting the driven roll of the pair 1 of draw rolls is in the form of a harmonic drive which in a conventional manner comprises two rotating circular splines 30 and 31 which are coupled with each other by a flex spline 32, which is drivingly mounted on a driven oval wave generator 33. The drive shaft 34 of the wave generator 33 is connected via a flange mounted tubular housing 36 and a shaft coupling 37 with the main motor 3. The output circular spline 31 is connected with a drive wheel 38 by means of a flange and the drive wheel 38 is in mesh with a drive wheel 40 keyed on the roll of the pair 1 of draw rolls. It will the seen that there is thus a substantial step down in the speed of rotation of the auxiliary motor 4 so that the latter may be a motor with a comparatively low power. At the same time there is a smooth change in the speed of rotation of the draw rolls in accordance with changes in the web tension.

The illustrated drive device for the pair 1 of draw rolls via the variable speed main motor 3 and the auxiliary motor 4 which is controlled as regards the speed of rotation and the web tension means that there is no need for a mechanical connection between the pair 1 of draw rolls and the longitudinal shaft.

We claim:

1. A web feed printing press comprising a longitudinal shaft for driving at least one printing unit and with a device for driving at least one web draw roll, wherein the drive means associated with each draw roll comprises a main motor and an auxiliary motor with means for regulating the speed of the two motors and a differential drive with two inputs and an output, the speed of rotation of the main motor being able to be varied in accordance with the speed of rotation of the longitudinal shaft and the speed of rotation of the auxiliary motor being able to be varied in accordance with the speed of the longitudinal shaft and of the tension of the web to be printed and the auxiliary motor is connected with a differential element of the differential drive by means of which element a speed difference between, on the one hand, the rotation of the input of the differential drive connected with the main motor and, on the other hand, the output, connected with the draw roll, of the differential may be produced.

2. The web feed printing press as claimed in claim 1 wherein the main motor and the auxiliary motor are respectively in the form of DC motors.

3. The web feed printing press as claimed in claim 1 having a pair of such draw rolls and wherein the said differential drive is in the form of a harmonic drive comprising a wave generator connected with the auxiliary motor, an input circular spline connected with the said main motor and an output circular spline connected with the driven roll of the associated pair of draw rolls.

4. The web feed printing press as claimed in claim 1 wherein the means for regulation of the auxiliary motor comprises a cascade with two regulation circuits of which a first one is adapted to respond to the tension of the web and a second one is adapted to respond to the speed of rotation of the longitudinal shaft and to be dependent on the said first regulation circuit.

5. The web feed printing press as claimed in claim 1 comprising respective pulse generators for responding to the speed of rotation of the longitudinal shaft, of the main motor and of the auxiliary motor and for representing set point values and actual values in the form of pulses.

6. The web feed printing press as claimed in claim 4 comprising a potentiometer for changing the set point of the first regulation circuit and a dandy roll with a measuring element for responding to the web tension and supply an actual value signal for the web tension.

7. The web feed printing press as claimed in claim 4 comprising respective thyristors with digital drive circuits therefor so that they may be operated by the respective first and second regulation circuits for control of the main and auxiliary motors respectively.

* * * * *